United States Patent [19]

Thomas

[11] Patent Number: 4,804,143

[45] Date of Patent: Feb. 14, 1989

[54] FUEL INJECTION NOZZLE UNIT

[75] Inventor: Gerald S. Thomas, Gloucester, England

[73] Assignee: Lucas Industries Public Limited Company, Birmingham, England

[21] Appl. No.: 709,303

[22] Filed: Mar. 7, 1985

[30] Foreign Application Priority Data

Apr. 5, 1984 [GB] United Kingdom ..... 8408752

[51] Int. Cl.[4] ..... B05B 9/00; F02M 55/00

[52] U.S. Cl. ..... 239/126; 239/533.3

[58] Field of Search ..... 239/533.3–533.12, 239/124, 125, 126

[56] References Cited

U.S. PATENT DOCUMENTS

| | | | |
|---|---|---|---|
| 2,358,494 | 9/1944 | Haines | 239/533.3 |
| 2,374,614 | 4/1945 | Nichols | 239/533.8 |
| 2,927,737 | 3/1960 | Zeuch et al. | 239/533.3 |
| 3,351,288 | 11/1967 | Perr | 239/533.3 |
| 3,425,635 | 2/1969 | Guertler | 239/533.3 |
| 3,430,866 | 3/1969 | Guertler | 239/533.3 |
| 3,831,863 | 8/1974 | Fenne | 239/533.8 |
| 4,205,789 | 6/1980 | Raufeisen | 239/533.3 |
| 4,258,883 | 3/1981 | Hofmann et al. | 239/124 |
| 4,616,781 | 10/1986 | Gaskell | 239/533.4 |

FOREIGN PATENT DOCUMENTS

| | | | |
|---|---|---|---|
| 199433 | 2/1958 | Austria | 239/533.3 |
| 762864 | 12/1956 | United Kingdom | 239/533.3 |

*Primary Examiner*—Andres Kashnikow
*Assistant Examiner*—Michael J. Forman

[57] ABSTRACT

A fuel injection nozzle unit has an inwardly opening valve member which can be moved by fuel pressure in a chamber connected to a fuel inlet to allow fuel flow through an outlet orifice. In order to circulate fuel through the chamber a passage leads therefrom to a fuel outlet. A restrictor is located in the passage and the valve member acts to prevent flow through the passage when it is open to allow fuel flow through the outlet orifice.

9 Claims, 2 Drawing Sheets

FUEL INJECTION NOZZLE UNIT

This invention relates to fuel injection nozzle units for supplying fuel to a compression ignition engine, the nozzle unit being of the kind comprising a fuel pressure actuated valve member which moves in response to fuel supplied at high pressure through a fuel inlet, to an open position to allow fuel flow through an outlet orifice, the nozzle unit also including a fuel outlet through which fuel from said inlet can flow at least when the valve member is in the closed position.

The purpose of allowing fuel flow between the inlet and the outlet is in some cases to cool the nozzle unit and in other cases where the fuel has to be heated, to allow it to be delivered to the associated engine, to permit the fuel to be circulated in the fuel system including the nozzle unit, at least before trying to start the associated engine. A known form of nozzle unit incorporates a pressure responsive valve in or adjacent the aforesaid outlet and this valve closes under the influence of the high pressure of fuel delivered to the inlet to achieve fuel delivery but opens to allow fuel to be circulated at low pressure. The valve has to be designed to withstand the high pressure and it must be responsive to the pressure drop across a restricted orifice through which the fuel flows to the outlet. The size of the orifice has to be a compromise between ensuring adequate flow of fuel when the pressure at the inlet is low and also ensuring that there is sufficient pressure drop to operate the valve when the pressure at the inlet is high.

The object of the present invention is to provide a nozzle unit of the kind specified in a simple and convenient form.

According to the invention a nozzle unit of the kind specified comprises a restricted orifice in a fuel flow passage from said inlet to said outlet, and valve means the moving component of which is defined by said valve member which closes said flow path when the valve member is moved to the open position.

Examples of nozzle units in accordance with the invention will now be described with reference to the accompanying drawings in which.

Figure 1:
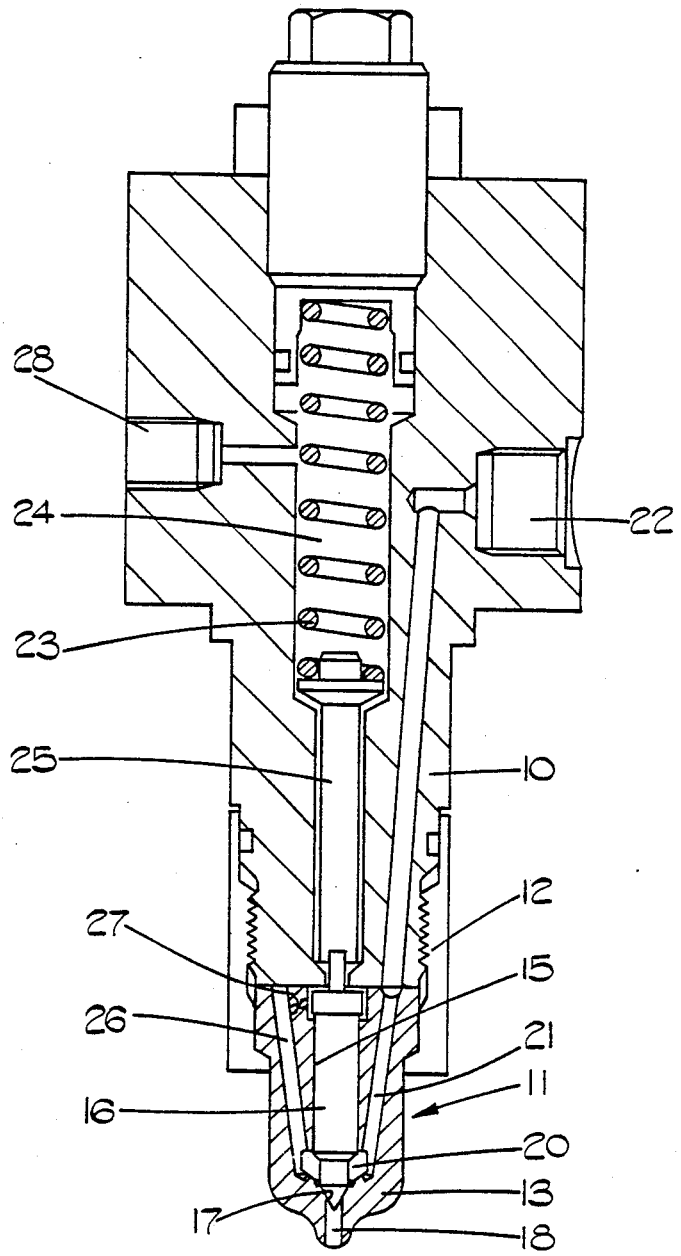
FIG. 1 is a part sectional side elevation of the nozzle unit.

Referring to FIG. 1 of the drawings the nozzle unit comprises a main body 10 to which is secured a nozzle assembly 11, a cap nut 12 being utilised to maintain the body and nozzle assembly in assembled relationship. The nozzle assembly comprises a stepped valve body 13 which extends through a hole in the base wall of the cap nut and in use, is exposed in a combustion space of the associated engine.

The valve body defines a bore 15 in which is located a slidable valve member 16 which is shaped at one end to co-operate with a seating 17 defined at the inner end of an outlet orifice 18. Adjacent the seating the bore 15 is of enlarged diameter, the valve member also being of reduced diameter in this region to define a chamber 20 to which liquid fuel can be supplied through an inlet passage 21 which extends to a fuel inlet 22 formed in the body 10. The fuel inlet 22 in use, is connected to the outlet of a fuel injection pump which delivers fuel at high pressure and in timed relationship with the associated engine.

The valve member 16 is biased into contact with the seating by means of a coiled compression spring 23 which is located within a chamber 24 defined in the body 10. The valve member has a reduced end portion which is engaged by a spring abutment 25.

In operation, when fuel under pressure is supplied to the inlet 22 the pressure of fuel in the chamber 20 acts upon the valve member 16 to lift the valve member from the seating against the action of the spring to allow fuel flow through the outlet orifice 18. The extent of movement of the valve member is limited by its abutment with the end wall of the body 10.

Figure 2:
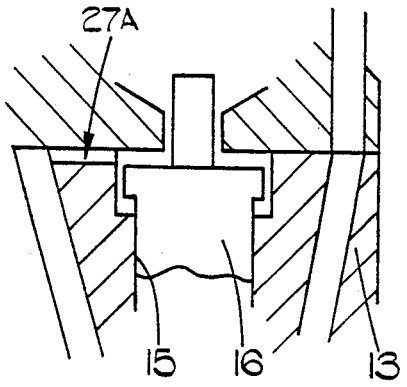
FIGS. 2, 3 and 4 show modifications of part of the nozzle unit of FIG. 1 to an enlarged scale.
Figure 3:
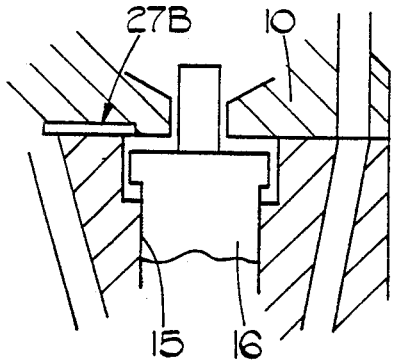

A further passage 26 is formed in the valve body 13 and at one end the passage communicates with the chamber 20. At its other end it is closed by the end of the body 10 but intermediate its ends it communicates by way of a restricted orifice 27 with a slightly enlarged portion of the bore 15 surrounding the end of the valve member 16 adjacent the body 10. Fuel can flow from the chamber 20 through the restricted orifice 27 into the chamber 24, the abutment 25 being slightly smaller than the extension of the chamber 24 in which it is located, to permit such flow. From the chamber 24 the fuel flows to an outlet 28 formed in the body 10. In use when fuel is supplied at low pressure to the inlet 22 the valve member 16 remains in contact with its seating. However, fuel flow occurs along the passage 21 through the chamber 20, along the passage 26 and by way of the orifice 27 to the chamber 24 and the outlet 28. When fuel is supplied at high pressure to the inlet 22, the valve member lifts and in so doing closes onto the end of the body 10 so as to prevent flow of fuel through the orifice 27. Although the orifice 27 is shown in a short passage it may in fact be formed by a slot 27A formed in the end of the valve body 13 as shown in FIG. 2 or by a slot 27B in the end of the main body 10 as shown in FIG. 3. The radial dimensions of the slots are such that flow of fuel along the slots is prevented when the valve member 16 is in contact with the end of the body 10.

The size of the orifice or slot has to be chosen so that there is sufficient pressure rise in the chamber 20 to effect opening of the valve member 16 when high pressure fuel is delivered by the pump.

The associated fuel injection pump is preferably supplied without the usual form of non-return delivery valve so that following delivery of fuel, and opening of a fuel supply port to the pumping chamber of the pump, the pressure of fuel delivered by the source of fuel which supplies the pump will cause flow of fuel through the pump chamber and the pipeline connecting the pump chamber with the fuel inlet 22.

Figure 4:
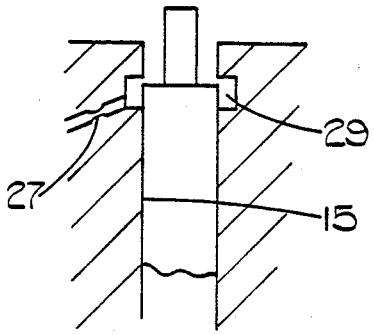

In the modification shown in FIG. 4 the bore 15 is provided with a circumferential groove 29 with which the restricted orifice 27 is in comminication. The valve member 16 in the closed position uncovers the groove 29 to the chamber 24 to allow flow of fuel. However, when the pressure of fuel is sufficient to lift the valve member the latter closes the groove to prevent flow of fuel into the chamber 24.

I claim:

1. A fuel injection nozzle unit for supplying fuel to a compression engine comprising:

a main body;

a nozzle body connected to said main body;

a bore defined in the nozzle body;

a chamber located at one end of said bore and which is adapted to contain fuel therein;

an outlet orifice in said nozzle body extending from said chamber;

a seating defined on said nozzle body in said chamber adjacent to said outlet orifice;

a valve member slidably positioned in said bore and shaped at one end thereof for co-operation with said seating, said valve member being adapted to be moved by pressure exerted thereon by fuel in said chamber;

a resilient means located in said main body and biasing the valve member one end into contact with said seating;

a fuel inlet in said main body and adapted to be in fluid communication with said bore and in fluid communication with said chamber;

a surface defined on said valve member against which the pressure of fuel supplied to said inlet can act in opposition to the force exerted by said resilient means;

a fuel outlet in said main body;

a fuel circulation flow path means extending through said main and nozzle bodies, said flow path means extending between said fuel inlet and said fuel outlet and being adapted so that fuel supplied to said fuel inlet can flow therethrough at least when the valve member one end is in contact with said seating, said flow path means including a fuel inlet passage fluidly connected to said fuel inlet and extending through said main body and through said nozzle body and which is fluidly connected to said chamber, and a further fuel passage in said nozzle body which is fluidly connected to said chamber and which is dead-ended by said main body, a spring chamber defined in said main body and which is fluidly connected to said fuel outlet, a flow port fluidly connecting said spring chamber to said nozzle body bore, and a restricted orifice passage means in said nozzle body fluidly connecting said further fuel passage to said nozzle body bore; and said valve member including a portion thereof which is located between said restricted orifice passage means and said flow port and which is movable with said valve member to be moved from a flow port opening position when said valve member one end is engaged against said bore seating so that fluid is permitted to flow through said flow path means from said fuel inlet to said fuel outlet to a flow port closing position when said valve member one end has moved away from said bore seating a predetermined distance so that when the valve member is moved said predetermined distance away from said seating, flow of fuel through said flow path means is prevented.

2. A nozzle unit according to claim 1, wherein means securing the nozzle body to said main body, said main body partly covers said bore to define a stop surface for the valve member operable in the flow path opening position of the valve member, said stop surface also defining a fixed component of said valve member.

3. A nozzle unit according to claim 2 in which said flow path means includes a groove defined between said bodies, said groove defining said restricted orifice.

4. A nozzle according to claim 1 wherein said fuel inlet passage and said further fuel passage extend longitudinally through the main body and through said nozzle body respectively, and said spring chamber extends longitudinally through said main body.

5. A nozzle according to claim 1 wherein said fuel inlet passage and said further fuel passage are connected to said chamber on opposite sides of said chamber.

6. A nozzle according to claim 1 further including a spring abutment element connecting said resilient means to said valve member, and said spring chamber has a size adjacent to said abutment element that is different from the size of said spring chamber adjacent to said resilient means.

7. A nozzle according to claim 6 wherein said abutment element includes a conical head abutting said resilient means, with said conical element having a sloping surface facing said outlet orifice and a flat surface abutting said resilient means.

8. A nozzle according to claim 1 further including a second chamber adjacent to said restricted orifice passage.

9. A nozzle according to claim 8 wherein said portion of said valve member includes an enlarged head on said valve member.

* * * * *